US007554028B2

(12) United States Patent
Fujii

(10) Patent No.: US 7,554,028 B2
(45) Date of Patent: Jun. 30, 2009

(54) PERFORMANCE ASSIST APPARATUS OF WIND INSTRUMENT

(75) Inventor: Junji Fujii, Shizuoka-Ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 11/615,036

(22) Filed: Dec. 22, 2006

(65) Prior Publication Data

US 2007/0144336 A1 Jun. 28, 2007

(30) Foreign Application Priority Data

Dec. 27, 2005 (JP) ..... 2005-376101

(51) Int. Cl.
*G10H 3/26* (2006.01)
*G10H 1/46* (2006.01)

(52) U.S. Cl. ..... 84/741; 84/723

(58) Field of Classification Search ..... 84/723, 84/729, 730, 732, 735, 741
See application file for complete search history.

(56) References Cited

U.S. PATENT DOCUMENTS 3,571,480 A 3/1971 Tichenor et al.
3,878,748 A 4/1975 Spence
5,543,580 A 8/1996 Masuda et al.
2005/0056139 A1 3/2005 Sakurada
2007/0068372 A1 3/2007 Masuda et al.

FOREIGN PATENT DOCUMENTS

FR 2775823 9/1999
JP 2004-177828 6/2004
JP 2004-258443 9/2004
JP 2007-065199 3/2007

*Primary Examiner*—Jeffrey Donels
*Assistant Examiner*—Andrew R Millikin
(74) *Attorney, Agent, or Firm*—Harness, Dickey & Pierce, PLC

(57) ABSTRACT

In an apparatus for assisting play of a wind instrument, an actuator is attached to the wind instrument for vibrating a portion of the wind instrument so as to assist play of the wind instrument. A microphone receives a vibration of a sound generated by the wind instrument and generates a vibration signal representing the vibration of the sound. A breath pressure sensor detects a pressure of a breath that is blown into the wind instrument during the play thereof, and generates a breath pressure signal corresponding to the detected pressure of the breath. A controller generates a control signal corresponding to the product of an inverse value of an envelope of the vibration signal and a value of the breath pressure signal. A variable gain amplifier amplifies the vibration signal with a variable gain which varies in response to the control signal so that an output signal of the variable gain amplifier is provided to enable the excitation part to vibrate the portion of the wind instrument.

10 Claims, 2 Drawing Sheets

PERFORMANCE ASSIST APPARATUS OF WIND INSTRUMENT

BACKGROUND OF THE INVENTION

1. Technical Field of the Invention

The present invention relates to a performance assist apparatus that can assist a person in playing a musical instrument.

2. Description of the Related Art

A technology in which a musical instrument is played automatically using a machine is widely known. For example, player organs or player pianos that play music automatically have been produced since a long time ago. Recently, in addition to such machines that can play a keyboard instrument automatically, machines that can play a wind instrument automatically have been developed. A device that plays a brass instrument automatically is descried in Japanese Patent Application Publication No. 2004-177828 and Japanese Patent Application Publication No. 2004-258443.

In the conventional player organ or piano or the technology described in the above noted patent documents, a machine plays all performances automatically and users do nothing but listen to the performances. In the meantime, many people have a desire to play an instrument by themselves. For example, many people desire to enjoy playing an instrument through their own manipulations even though they have a poor playing skill. These conventional technologies cannot satisfy such a desire to play an instrument.

One method may be designed to energetically assist in blowing a brass instrument. Such a device may receive a performance sound through a microphone or the like and electrically amplify the sound and then output it through a speaker. However, in this case, howling (i.e., acoustic feedback) occurs between the microphone and the speaker.

SUMMARY OF THE INVENTION

Therefore, the present invention has been made in view of the above circumstances, and it is an object of the present invention to provide a technology for a wind instrument which can assist a performer in playing the instrument while preventing the occurrence of howling.

In order to solve the above problems, the present invention provides an apparatus for assisting play of a wind instrument, comprising: an excitation part that is attached to the wind instrument for vibrating a portion of the wind instrument so as to assist play of the wind instrument; a vibration signal generation part that receives a vibration of a sound generated by the wind instrument and that generates a vibration signal representing the vibration of the sound; a breath pressure sensor that detects a pressure of a breath that is blown into the wind instrument during the play thereof and that generates a breath pressure signal corresponding to the detected pressure of the breath; a control signal generation part that generates a control signal corresponding to the product of an inverse value of an envelope of the vibration signal and a value of the breath pressure signal; and a variable gain amplifier that is connected to the excitation part and that amplifies the vibration signal with a variable gain which varies in response to the control signal so that an output signal of the variable gain amplifier is provided to enable the excitation part to vibrate the portion of the wind instrument.

In a preferred aspect of the present invention, the breath pressure sensor detects a static component of the pressure of the breath that is blown into the wind instrument, and generates the breath pressure signal corresponding to the detected static component of the pressure of the breath. In such a case, the vibration signal generation part and the breath pressure sensor may be constructed using one sensor device that can detect the vibration of the sound to generate the vibration signal and that can concurrently detect the static component of the pressure of the breath to generate the breath pressure signal.

In another preferred aspect of the present invention, the excitation part and the vibration signal generation part are mounted together on a mouthpiece of the wind instrument.

In a further preferred aspect of the present invention, the vibration signal generation part, the breath pressure sensor and the excitation part are mounted in a mouthpiece of the wind instrument so that the vibration signal generation part, the breath pressure sensor and the excitation part are exposed to an air duct which passes through the mouthpiece.

The present invention can prevent the occurrence of howling in a wind instrument and also can assist a performer in playing the instrument. The present invention amplifies a performance sound to allow even a performer having a poor playing skill to play a good performance.

DETAILED DESCRIPTION OF THE INVENTION

Figure 1:
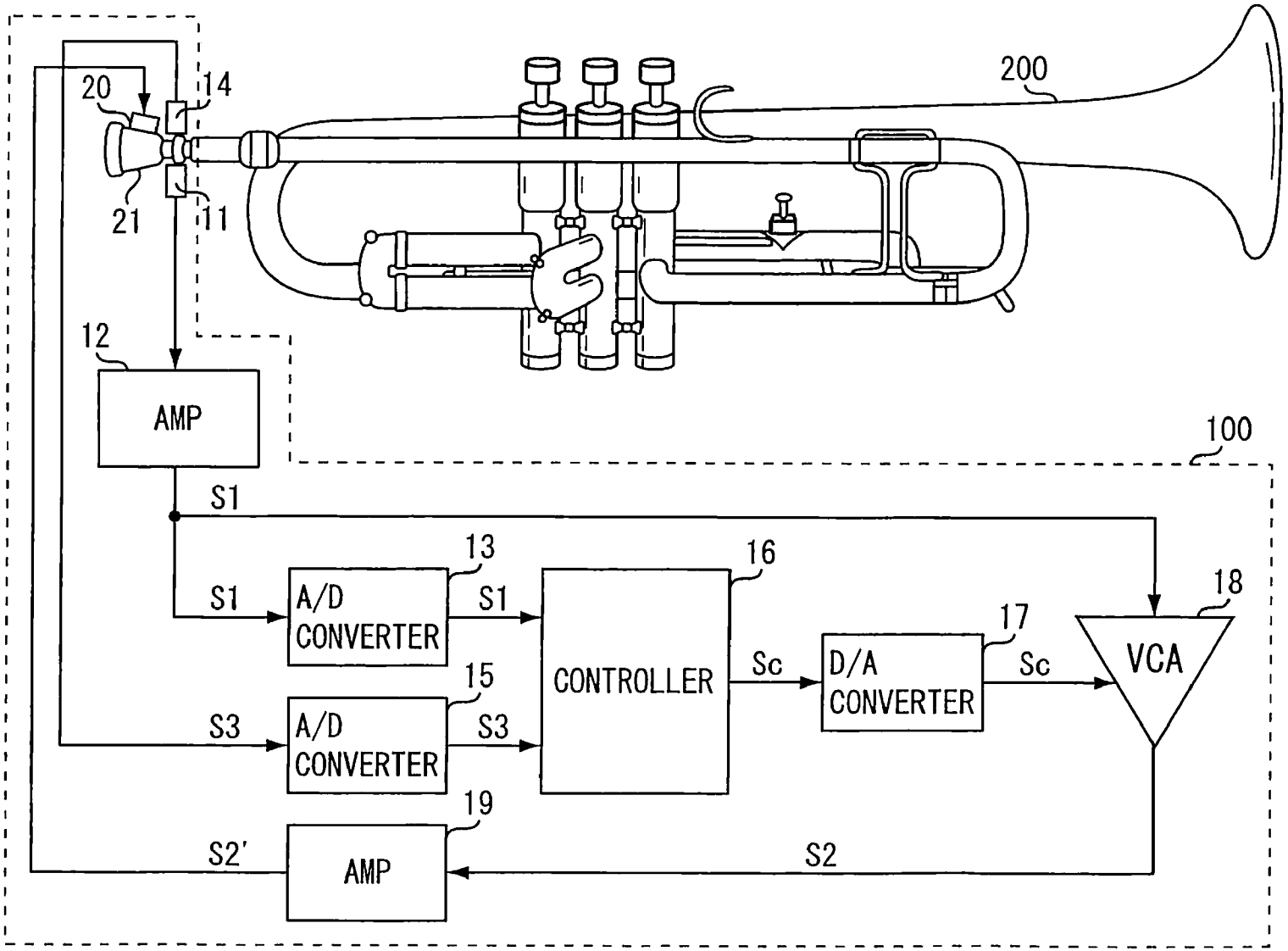
FIG. 1 is a diagram illustrating the configuration of a performance assist apparatus according to an embodiment of the present invention.

FIG. 1 is a schematic diagram illustrating an example of the configuration of a performance assist apparatus 100 according to an embodiment of the present invention. In FIG. 1, the performance assist apparatus 100 is shown as a part surrounded by a dashed line and reference numeral "200" denotes a trumpet. "21" denotes a mouthpiece that is used by attaching it to the trumpet 200. A description of each element of the trumpet 200 is omitted since it is a general trumpet.

In FIG. 1, reference numeral "11" denotes a microphone that is a vibration signal generation part for receiving a sound and generating an analog vibration signal representing a vibration of the received sound. The microphone 11 is mounted in the mouthpiece 21 so as to be exposed to an air duct of the mouthpiece. "12" denotes an amplifier that is connected to the microphone 11 and amplifies a vibration signal output from the microphone 11 and outputs the amplified vibration signal S1. "13" denotes an A/D converter that converts the analog vibration signal S1 input from the amplifier 12 into a digital vibration signal and outputs the digital vibration signal.

Reference numeral "14" denotes a breath pressure sensor that detects breath pressure of a performer and generates an analog signal representing the breath pressure, which will be referred to as a breath pressure signal S3. "15" denotes an A/D converter that converts the breath pressure signal S3 input from the breath pressure sensor 14 into a digital signal and outputs the corresponding digital signal.

Reference numeral "16" denotes a controller that includes a computing unit such as a central processing unit (CPU) and a variety of memories such as a read only memory (ROM) or a random access memory (RAM). The computing unit of the controller 16 performs a variety of processes by reading and executing computer programs stored in a memory such as a ROM. Specifically, the controller 16 constitutes a control signal generation part for generating a control signal Sc based on both the vibration signal S1 and the breath pressure signal S3 provided from the A/D converters 13 and 15. The breath pressure signal is a signal representing a static component (DC component) of the breath pressure or a low frequency component of the breath pressure in the order of up to 10 Hz corresponding to notes or beats of music.

Reference numeral "17" denotes a D/A converter that converts a digital control signal Sc provided from the controller 16 into a corresponding analog signal and outputs the analog signal. "18" denotes a voltage controlled amplifier (VCA) that is a variable gain amplifier for amplifying the vibration signal S1 provided from the amplifier 12 with a variable gain determined based on the control signal Sc provided from the D/A converter 17 and outputs the amplified vibration signal S2. "19" denotes an amplifier that amplifies the signal S1 provided from the VCA 18 and outputs the amplified vibration signal S2'. "20" denotes a vibration actuator that is attached to the mouthpiece 21 so as to be exposed to the duct and vibrates a portion of the duct to which the vibration actuator is attached. The vibration actuator 20 is an excitation part attached to the wind instrument and causes vibration according to the vibration signal S2' provided from the amplifier 19 to generate an acoustic wave.

A description will now be given of the operation of the performance assist apparatus in this embodiment constructed as described above. When a performer places their lips on the mouthpiece 21 and plays a performance by blowing a breath into the mouthpiece 21, the microphone 11 receives a sound generated inside the mouthpiece 21 and generates a vibration signal representing a vibration of the generated sound. The breath pressure sensor 14 detects a breath pressure inside the mouthpiece 21 and generates a breath pressure signal S3 representing the detected breath pressure.

The input vibration signal generated by the microphone 11 is amplified by the amplifier 12 and the amplified vibration signal S1 is input to the VCA 18. The VCA 18 amplifies the input vibration signal S1 and inputs the amplified vibration signal S2 to the amplifier 19. The amplifier 19 amplifies the vibration signal S2 and provides the amplified output vibration signal S2' to the vibration actuator 20. The vibration actuator 20 causes vibration according to the signal S2' provided from the amplifier 19. As the vibration actuator 20 vibrates, an acoustic wave is generated inside the mouthpiece 21.

As described above, the vibration signal input to the microphone 11 is amplified through the amplifier 12, the VCA 18, and the amplifier 19 and then a sound corresponding to the amplified vibration signal is generated by the vibration actuator 20. Accordingly, in addition to a performance sound actually played by a performer, a further performance sound generated by the vibration actuator 20 based on the amplified vibration signal S2' is generated in the mouthpiece 21. In this manner, the performance sound is output from the vibration actuator 20 and the output sound resonates in the duct of the trumpet 200, thereby making it possible to amplify the performance sound of the performer.

A description will now be given of a process for generating the control signal Sc of the controller 16. The amplifier 12 inputs the vibration signal S1 to the VCA 18 while providing the same vibration signal S1 to the A/D converter 13. The A/D converter 13 converts the vibration signal S1 input from the amplifier 12 into a digital vibration signal and provides it to the controller 16. The breath pressure signal S3 detected by the breath pressure sensor 14 is provided to the A/D converter 15 and the A/D converter 15 then converts the input breath pressure signal S3 into a digital breath pressure signal S3 and provides it to the controller 16. Thus, both the vibration signal S1 and the breath pressure signal S3 are input to the controller 16.

Upon receiving the vibration signal S1 and the breath pressure signal S3, the controller 16 detects an envelope of an amplitude of the vibration signal S1 and calculates the inverse value of the envelope. For example, when the detected envelope value is "p" at a certain time, the controller 16 calculates "1/p" as its inverse number. The controller 16 then calculates the product of the input breath pressure signal S3, a specific coefficient, and the calculated inverse number (1/p) and determines the calculated product to be the control signal Sc. For example, if the specific coefficient is "a" and the value of the breath pressure signal S3 is "q", "a×q×(1/p)" is generated as the control signal Sc.

The controller 16 inputs the generated control signal Sc to the D/A converter 17. The D/A converter 17 converts the input digital control signal Sc into a corresponding analog signal and inputs it to the VCA 18. The VCA 18 amplifies the vibration signal S1 provided from the amplifier 12 based on the control signal Sc provided from the D/A converter 17 and outputs the amplified vibration signal S2.

In this case, the VCA 18 multiplies the waveform of the input vibration signal S1 by the control signal Sc. For example, since the envelope value of the input vibration signal S1 in the above example is "p", the envelope value of the waveform of the vibration signal S2 is $$\text{“}p\times(a\times q\times(1/p))=a\times q\text{”}.$$

As described above, the envelope value of the waveform of the vibration signal S2 is the product of the value "q" of the breath pressure signal S3 and the coefficient "a". That is, the envelope value of the vibration signal S2' provided to the vibration actuator 20, which is obtained by multiplying "a×q" and the gain of the amplifier 19, depends only on the value "q" of the breath pressure signal, without depending on the envelope value "p" of the vibration signal S1 detected by the microphone 11. Since the value of the output vibration signal S2' provided to the vibration actuator 20 does not depend on the envelope value of the input vibration signal S1 detected by the microphone 11, a sound or vibration generated by the vibration actuator 20 is not amplified even if the sound or vibration propagates around the mouthpiece and inputs to the microphone 11, thereby preventing howling.

In the related art, howling occurs when the vibration actuator 20 and the microphone 11 are mounted near each other. On the other hand, in this embodiment, the vibration actuator 20 and the microphone 11 can be mounted near each other since howling can be prevented. This makes it possible to mount the vibration actuator 20 and the microphone 11 together on the mouthpiece 21.

The VCA 18 amplifies the vibration signal S1 according to the value of the breath pressure signal S3. That is, since the value of the vibration signal S2' provided to the vibration actuator 20 depends on the breath pressure signal S3, it is possible to assist the performer in playing a performance according to their breath pressure. Specifically, as the breath pressure of the performer increases, the audio volume of a sound generated by the vibration actuator 20 increases. On the other hand, as the breath pressure of the performer decreases, the audio volume of a sound generated by the vibration actuator 20 decreases. The performer increases their exhaled breath when they desire to increase the volume of the performance sound and decreases the breath pressure when they desire to decrease the volume of the performance sound. Thus, it is possible to assist the performer in playing a normal performance.

Many beginners and intermediate players (performers) cannot exhale a breath with a high breath pressure and it is difficult for them to perform a wind performance with high sound volume. However, since the control signal Sc is generated in response to the breath pressure signal S3 corresponding to the breath pressure of the performer, and the vibration actuator 20 outputs a performance sound of an audio volume based on the generated control signal Sc, this embodiment makes it possible to output a large volume sound even if the performer exhales a small amount of breath, thereby allowing them to comfortably perform a wind performance with high volume.

[Modification]

While the present invention has been described with reference to the above embodiment, the present invention can be carried out in various other forms without being limited to the above embodiment. The following are examples.

(1) The microphone 11 is mounted on the mouthpiece 21 and the microphone 11 receives a sound generated in the mouthpiece 21 in the above embodiment. However, for example, a vibration sensor constructed using a piezoelectric element instead of the microphone may be mounted on the duct of the mouthpiece. In this case, the amount of vibration of air in the mouthpiece is detected by the vibration sensor and the detected vibration amount is amplified based on the breath pressure signal S3 and is then provided to the vibration actuator.

(2) The microphone for detecting a dynamic sound pressure and the breath pressure sensor for measuring the breath pressure are mounted separately in the above embodiment. However, for example, there is mounted one sensor such as a semiconductor which integrates the microphone and the breath pressure sensor into one chip device. The one chip sensor device can detect a vibration or dynamic pressure of the sound and generate a vibration signal, and also can detect a static component of the breath pressure blown into the wind instrument. In this case, the performance assist apparatus can be constructed in a simple configuration since both the vibration and the static pressure can be measured by one sensor.

(3) The value of the coefficient "a" in the above embodiment is arbitrary, which may be "1" depending on the circuitry. No matter which value the coefficient "a" is set to, the control signal Sc corresponds to the product of the inverse number of the envelope and the breath pressure signal.

(4) In the above embodiment, the amplifier 19 may be omitted if the output of the VCA 18 is high enough. Similarly, the amplifier 12 may be omitted if the output level of the microphone 11 is high enough.

Figure 2:
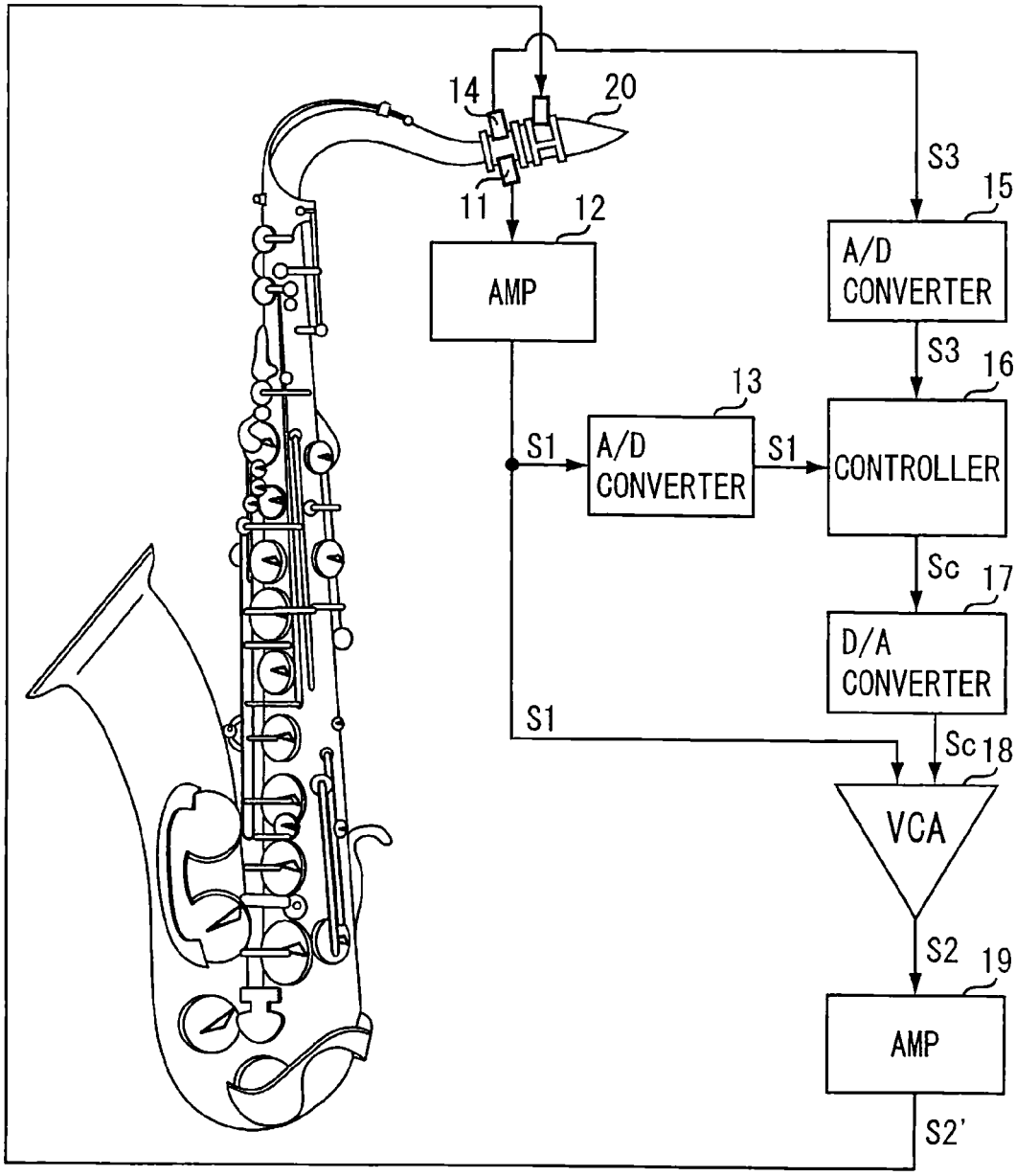
FIG. 2 illustrates the configuration of a performance assist apparatus according to a modification of the present invention.

(5) While the above embodiment has been described for a performance assist apparatus that assists in playing a trumpet, the instrument which is subjected to performance assist according to the present invention is not limited to the trumpet but may be applied to a different brass instrument such as a trombone or a horn, for example. The instrument may also be a woodwind instrument such as a saxophone or clarinet. FIG. 2 illustrates the configuration of a performance assist apparatus that assists in playing a saxophone. In FIG. 2, elements similar to those shown in FIG. 1 are denoted by the same reference numerals. In the example shown in FIG. 2, the microphone 11, the breath pressure sensor 14 and the vibration actuator 20 are mounted in a mouthpiece of the saxophone 300, which is a woodwind instrument, so that sensitive portion of the microphone 11, the breath pressure sensor 14 and the vibration actuator 20 are exposed to the air duct passing through the wind instrument in the same manner as in the above embodiment. The controller 16 generates a control signal Sc corresponding to the product of a breath pressure signal Sc and the inverse number of an envelope value of a vibration signal indicating a sound received by a microphone 11. The vibration actuator 20 is driven according to an output vibration signal S2 produced through amplification based on the control signal Sc. Accordingly, a sound or vibration generated by the vibration actuator 20 is not amplified even if the sound or vibration propagates around the mouthpiece and inputs to the microphone 11. This makes it possible to assist the performer in playing a normal performance while preventing howling.

In the case of a woodwind instrument, the vibration actuator 20 may be mounted on its reed rather than mounting the actuator on a duct of its mouthpiece so as to protrude into inside of the duct.

In place of the breath pressure sensor, a mechanical or optical device may be used to detect a movement of a lip of the player to generate a lip movement signal which can be utilized to generate the control signal instead of the breath pressure signal.

The invention claimed is:

1. In an apparatus to assist play of a wind instrument of the type having an excitation part attached to the instrument that vibrates a portion of the instrument to thereby assist play of the instrument; having a vibration signal generation part that produces a vibration signal in response to sound produced by the instrument and having a breath pressure sensor that generates a breath pressure signal in response to detected breath pressure produced by blowing into the instrument during the play thereof, a controller comprising:

a signal generator receptive of said vibration signal and said breath pressure signal, the signal generator detects an envelope of the amplitude of the vibration signal, generates an inverse of the envelope signal and produces a control signal corresponding to the product of the inverse envelope and the breath pressure signal; and a variable gain amplifier receptive of said control signal and said vibration signal that supplies an output signal to said excitation part of said wind instrument, said variable gain amplifier producing said output signal by applying a variable gain to said vibration signal which varies in accordance with said control signal.

2. The controller of claim 1 wherein said variable gain applied to said vibration signal reduces acoustic feedback.

3. The controller of claim 1 wherein said variable gain applied to said vibration signal includes a low frequency component corresponding to said detected breath pressure, and wherein said low frequency component controls the audio volume of sound produced by the excitation part according to the breath pressure supplied by a performer of the wind instrument.

4. The controller of claim 1 wherein said controller operates in the digital domain and is supplied by said vibration signal and said breath pressure signal via analog to digital convertors.

5. The controller of claim 4 wherein said variable gain amplifier operates in the analog domain and is supplied by said output signal via a digital to analog converter coupled to said controller.

6. A method to minimize acoustic feedback in an electronically assisted wind instrument of the type having an excitation part attached to the instrument that vibrates a portion of the instrument to thereby assist play of the instrument; having a vibration signal generation part that produces a vibration signal in response to sound produced by the instrument and having a breath pressure sensor that generates a breath pressure signal in response to detected breath pressure produced by blowing into the instrument during the play thereof, the method comprising the steps of:

detecting an envelope of the amplitude of the vibration signal and generating an inverse of the envelope signal;

multiplying the inverse of the envelope signal by the breath pressure signal to produce a control signal;

variably amplifying the vibration signal in accordance with the control signal and supplying the variably amplified vibration signal to the excitation part of the wind instrument.

7. The method of claim 6 wherein said step of generating an inverse envelope signal is performed at least in part in the digital domain.

8. The method of claim 6 wherein said multiplying step is performed at least in part in the digital domain.

9. The method of claim 6 wherein said inverse envelope signal is represented as digital data.

10. A method to minimize acoustic feedback in an electronically assisted wind instrument of the type having an excitation part attached to the instrument that vibrates a portion of the instrument to thereby assist play of the instrument; having a vibration signal generation part that produces a vibration signal in response to sound produced by the instrument and having a breath pressure sensor that generates a breath pressure signal in response to detected breath pressure produced by blowing into the instrument during the play thereof, the method comprising the steps of:

mathematically manipulating a digital representation of the vibration signal to produce an envelope of the vibration signal and a control signal based on an inverse of the envelope signal and on the pressure signal;

variably amplifying the vibration signal using the control signal to establish the amplifier gain while minimizing acoustic feedback; and supplying the variably amplified vibration signal to the excitation part of the wind instrument.

* * * * *